United States Patent [19]

Wenthe, Jr.

[11] Patent Number: 4,469,320

[45] Date of Patent: Sep. 4, 1984

[54] DUAL MODE STACK SENSOR

[75] Inventor: Stephen J. Wenthe, Jr., Rochester, N.Y.

[73] Assignee: Xerox Corporation, Stamford, Conn.

[21] Appl. No.: 373,919

[22] Filed: May 3, 1982

[51] Int. Cl.[3] ..... B65H 3/12; B65H 3/48; B65H 7/14

[52] U.S. Cl. ..... 271/98; 271/3.1; 271/94; 271/105; 271/165

[58] Field of Search ..... 271/98, 94, 99, 105, 271/165, 3.1, 4, 5

[56] References Cited

U.S. PATENT DOCUMENTS

| | | | |
|---|---|---|---|
| 3,945,633 | 3/1976 | Knopp | 271/3.1 |
| 4,076,408 | 2/1978 | Reid et al. | 355/14 |
| 4,231,562 | 11/1980 | Hori | 271/3.1 |
| 4,269,406 | 5/1981 | Hamlin | 271/108 |
| 4,278,344 | 7/1981 | Sahay | 355/14 SH |
| 4,299,381 | 11/1981 | Smith | 271/96 |
| 4,336,923 | 6/1982 | Smith et al. | 271/3.1 |
| 4,397,459 | 8/1983 | Silverberg et al. | 271/94 |

FOREIGN PATENT DOCUMENTS 2058023 9/1980 United Kingdom .

OTHER PUBLICATIONS

"Stack Weight Sensing Paper Tray", Xerox Disclosure Journal, Stephen J. Wenthe, Jr., vol. 7. No. 4, Jul./Aug. 1982.

"Segmented Friction Drive", Timothy S. Pinckney, Xerox Disclosure Journal, vol. 5, No. 4, Jul./Aug. 1980, p. 375.

"Air Adjustment-Automatic", Stephen Wenthe, Xerox Disclosure Journal, vol. 5, No. 4, Jul./Aug. 1980, p. 383.

"Document Set Separator", James E. Hutton & Morton Silverberg, Xerox Disclosure Journal, vol. 5, No. 6, Nov./Dec. 1980, pp. 625-626.

*Primary Examiner*—Bruce H. Stoner, Jr.
*Assistant Examiner*—John A. Carroll

[57] ABSTRACT

In a sheet feeder wherein sheets are fed from the bottom of a stack of the sheets in a stack support there is disclosed an automatic integral plural mode sheet stack sensor which, in a first mode, controls a variable pneumatic feeding means in response to sensing the height of the stack of sheets, and which, in a second mode, provides a signal indicative of the feeding from the stack support of all of the sheets in the stack. As further disclosed, a finger member is resettable on top of the stack of sheets, and a first switch is actuable by a first position of the finger member to increase the output of an air knife for assisting the bottom sheet feeder when the finger member is reset on top of the stack of sheets and the height of the stack of sheets exceeds a preset level, and a second switch is actuable for the second mode by the dropping of the finger member into a second position in response to all of the sheets being fed out from under the finger, and a fed sheet counter is connected to control the same variable pneumatic control so as to override the first mode control from the sheet stack sensor if a number of sheets is counted exceeding a preset count before the second mode signal.

7 Claims, 5 Drawing Figures

DUAL MODE STACK SENSOR

The present invention relates to sheet feeding, and particularly to a sheet stack sensing and control system for controlling sheet feeding in response to sensing the stack height and for sensing the feeding of the stack.

Especially for the faster xerographic and other document copiers now in commercial use, it is increasingly desirable to provide for the automatic handling of the original document sheets being copied, in order to more fully utilize the higher copying speed capabilities of these copiers. It is particularly desirable to rapidly automatically feed, register and copy document sheets of a variety or mixture of sizes, types, weights, materials, conditions and susceptibility to damage, yet with minimal document jamming wear or damage by the document handling apparatus.

A desirable feature for an automatic document handling system for a copier is to reliably provide plural document recirculations for precollation copying. Such precollation copying systems provide a number of advantages. The copies exit the copier into a set collector already in precollated sets, and do not require subsequent sorting in a sorter or collator. On-line finishing and/or removal of completed copy sets may be provided while additional copy sets are being made from the same document set. Also, a complete copy proof set is available from the first document set circulation. Any desired number of such copy sets may be made by making a corresponding number of recirculations of the document set in collated order past a copying station and copying each document once each time it recirculates, providing the document handler operates properly. Examples of such systems are further described in the patent literature.

However, a disadvantage of precollation copying systems is that the documents must all be repeatedly recirculated and repeatedly individually copied a number of times equivalent to the desired number of copy sets. For example, to make 10 copy sets of a 5 page document set or book, one copy at a time can be made of each of the 5 document pages in this order: pages 1, 2, 3, 4,5; 1, 2, 3, 4, 5; (or the reverse page order) repeated a total of 10 times to make the desired 10 copy sets. Thus, increased document recirculations are necessitated for a precollation copying system, with consequent increased likelihood of document jams and document wear, image smearing, or damage.

So-called recirculating document handlers (RDH's) perform the complex function of manipulating the document original in a controlled manner for precollation copying. In a typical commercial recirculating document handler, a stack of original document sheets are placed by the copier user in normal collated order in a copier stacking tray over a platen and then sequentially fed from the bottom of that tray to a conventional platen where they are imaged onto a photoreceptor. After one side of the original has been copied, the document is returned to the top of the stack in the stacking tray via a return feed path. Feeding the document sheets from the bottom of the stack around this loop or racetrack feed path becomes difficult, particularly if the feeder is to handle a variety of sizes, weights and conditions of papers at high speeds.

With bottom sheet feeding, the weight of the overlying sheets of the stack greatly affects the feeding even with the preferred pneumatic feeding systems disclosed and incorporated herein. The present inventor has suggested in a prior publication the use of a weight-sensing switch in combination with an air flotation of the stack, in the Xerox Disclosure Journal, Vol. 5, No. 4, July-/Aug. 1980, p. 383. However, the air flotation can interfere with the sheet feeding system and the weight sensing itself.

Art of interest to one feature of the system disclosed herein relates to the control of pneumatic sheet feeding means for feeding sheets from a stack, and particularly or specifically to controlling the air pressure level provided to and from an "air knife" for a recirculating document bottom feeder for a copier. Some examples of U.S. patents in this technology are 4,269,406 issued May 26, 1981 to T. J. Hamlim, and 4,299,381 issued Nov. 10, 1981 to R. E. Smith. Further details of a preferred such air knife are disclosed in U.S. Pat. No. 4,418,905, filed Nov. 2, 1981 by G. M. Garavuso, by the same assignee.

Of particular interest in this regard is an allowed U.S. Pat. No. 4,336,928 filed Aug. 4, 1980 by R. E. Smith, S. J. Wenthe (the present inventor) and W. J. Woznicki, by the same assignee. It teaches an initial air knife air pressure level setting which is arbitrarily assumed (without knowing the setting actually needed) until a count is made of sheets being fed from the document stack. Thereafter, if the number of sheets counted is more than a preset number (e.g. 7) the air knife level is switched to the appropriate leve if it differs, e.g. from a low level to a higher level to compensate for a higher weight of a larger than 7 sheet stack. This system is utilized in the Xerox Corporation "5600" and "8200" copiers. However, it has the obvious disadvantage of setting the air level initially and trying to feed sheets therewith without knowing whether that is the appropriate level. If the air level is too high, and there are only a small number of sheets in the stack, these sheets may be excessively fluttered or blown and interfere with or prevent feeding. On the other hand, if the air knife level is too low, the weight of the overlying stack may cause misfeeding or slippage of the bottom sheet feeder. If any sheets are misfed before the count level is reached telling the controller that additional air knife pressure is needed, a jam or machine shutdown may occur. Since precollation copying, particularly for duplex copying, requires coordination of the feeding of the document sheets with the copy sheets, a misfeeding of documents can cause a shutdown condition for the entire copier, not just the document handler, and may require removal of copy sheets from the copy path and reorienting of the originals in order to accomplish "job recovery".

Another important feature of known precollation copying systems is a means of detecting the feeding of all the sheets in the set from the stack support or tray area. This is needed to tell the system each time the complete document set is circulated, i.e. to keep track of the number of set circulations. This is typically coupled through the copier logic system to another sensor which counts the number of sheets being fed. With the combination of these two inputs or signals the number of document sheets in the document set can be readily determined after the first circulation. See, e.g., by way of further background, U.S. Pat. No. 4,278,344 issued July 14, 1981 to R. B. Sahay and the references cited therein. Such devices are known in the art as set counters, set separators or bail bars.

Such set separators may be utilized in sheet feeding applications other than RDH systems, for example, for copy sheets being duplexed as taught in U.K. published application G.B. Pat. No. 2,058,023A cited below, i.e. for keeping track of and separating duplex copy sheet sets being made in an automatic duplex (2 sided) copier. The system disclosed herein may also be utilized in such other applications.

The following art noted on bail bars (set separators) per se, and especially for recirculating document handlers, is listed here in numerical order: U.S. Pat. Nos. 3,556,513 issued Jan. 19, 1971 to A. Howard (Xerox). 3,815,896 issued June 11, 1974 to A. Hoyer (Xerox) (note especially FIGS. 7*a*–7*c*); 3,861,671 issued Jan. 21, 1975 to A. Hoyer (Xerox); 3,895,790 issued July 22, 1975 to A. Hoyer et al. (Xerox); 3,941,376 issued Mar. 2, 1976 to K. Liechty, et al. (Xerox); 3,954,259 issued May 4, 1976 to D. Gerbasi (Xerox); 4,078,787 issued Mar. 14, 1978 to Berlew et al. (Eastman Kodak) (note Ref. Nos. 90, 91, 92, 125 and Col. 8, second paragraph, Col. 10, Paragraph No. 5 and Col. 11, first paragraph); 4,116,558 issued Sept. 26, 1978 to J. Adamek et al. (Xerox) (note item 61, 61*a*, 61*b*); 4,164,347 issued Aug. 14, 1979 to T. McGrain (Eastman Kodak); 4,231,561 issued Nov. 4, 1980 to T. Kaneko et al. (Ricoh) (note e.g. Col. 11, lines 35–46); 4,231,562 issued Nov. 4, 1980 to T. Hori (Savin); U.K. patent application GB 2,058,023A published Apr. 8, 1981 (Xerox); German OLS 2232023 laid open Jan. 17, 1974 Licentia Patent-Verwaltungs GMBH; U. S. P. T. O. Defensive Publication No. T964,008 published Nov. 1, 1977 by W. E. Hunt (Eastman Kodak); The U.K. "Research Disclosure" Journal Publications Nos. 15842 of June 1977 and 20433 of Apr. 1981; and the "Xerox Disclosure Journal", Vol. 5, No. 4 July/Aug. 1980, p. 375, Vol. 5, No. 6, Nov./Dec. 1980, pp. 625-6. Also noted is other art cited on the faces of or in the above references.

By way of further background, examples of other RDH's with which the present invention may be used include U.S. Pat. Nos. 4,278,344 issued July 14, 1981 to R. B. Sahay; 4,270,746 issued June 2, 1981 to T. J. Hamlin, and 4,076,408 issued Feb. 28, 1978 to M. G. Reid, et al. The latter patent includes an optical detector 149,151 in the document tray. A similar disclosure is in Pat. No. 4,099,860 issued July 11, 1978 to J. L. Connin.

The art also includes various other patents teaching various other document handlers and control systems therefor such as U.S. Pat. Nos.: 4,054,380; 4,062,061; 4,076,408; 4,078,787; 4,099,860; 4,125,325; 4,132,401; 4,144,550; 4,158,500; 4,176,945; 4,197,215; 4,229,101; 4,278,344; 4,284,270 and 4,312,587.

Conventional simple software instructions in the copier's general microprocessor logic circuitry and software of all document handler and copier control functions and logic, as taught by the above and other patents and various commercial copiers, is well known and preferred. However, it will be appreciated that the document sensing and handling functions and controls described herein may be alternatively conventionally incorporated easily into any copier utilizing any other suitable or known simple software or hard wired logic systems, (e.g. simple combinations of registers or counters, "and" gates, "or" gates or the like), with conventional switches and solenoids, etc. Specific software instructions for functions described herein may vary somewhat depending on the particular microprocessor or microcomputer system and language utilized, of course, but is already available to or readily programmable by those skilled in the art without experimentation from the descriptions provided herein and the above and other references.

All of the art and references cited herein, and their references, are incorporated by reference herein for appropriate teachings of additional or alternative details, features, and/or technical background.

The present invention overcomes or reduces various of the abovediscussed problems. In particular, a preferred feature disclosed herein is to provide a method and apparatus, in a sheet feeder with a sheet stack support wherein sheets are fed from a stack of the sheets in said slack support using variable pneumatic feeding means of an improvement comprising an automatic integral plural mode sheet stack sensor which, in a first mode, controls said variable pneumatic feeding means in response to sensing the height of the stack of sheets in said stack support, and which, in a second mode, provides a signal indicative of the feeding from said stack support of all of the sheets in said stack.

Further features or details disclosed herein include embodiments including a finger member, means for resetting said finger member on top of the stack of sheets, first switch means actuable by a first position of said finger member for said first mode when said finger member is reset on top of the stack of sheets and the height of said stack of sheets in said stack support exceeds a preset level, and second switch means actuable for said second mode by the dropping of said finger member into a second position in response to all of the sheets being fed out from under said finger member; and/or wherein the sheet stack sensor in said first mode initially increases the air pressure to a pneumatic sheet separator operating on said stack in response to sensing that the height of the stack exceeds a preset level; and/or wherein sheet counting means are provided to count the sheets fed from said stack, and wherein said sheet counting means are also connected to control said variable pneumatic feeding means, and are connected to override said first mode control from said sheet stack sensor in response to counting a number of sheets differing from a preset sheet count; and/or wherein said sheet stack sensor finger member has an integral flag extension member adapted to selectively interrupt selected ones of a plurality of light beam sensors in response to the finger member position, which finger member position is normally controlled by a portion of said finger member resting on said stack and being freely movable downwardly by gravity as sheets are fed out from under it.

Further desirable features and advantages pertain to the specific apparatus and steps of operation whereby the above-mentioned and other features and advantages may be attained, including the specific examples described hereinbelow which include the following drawing figures (approximately to scale) wherein.

Figure 1:
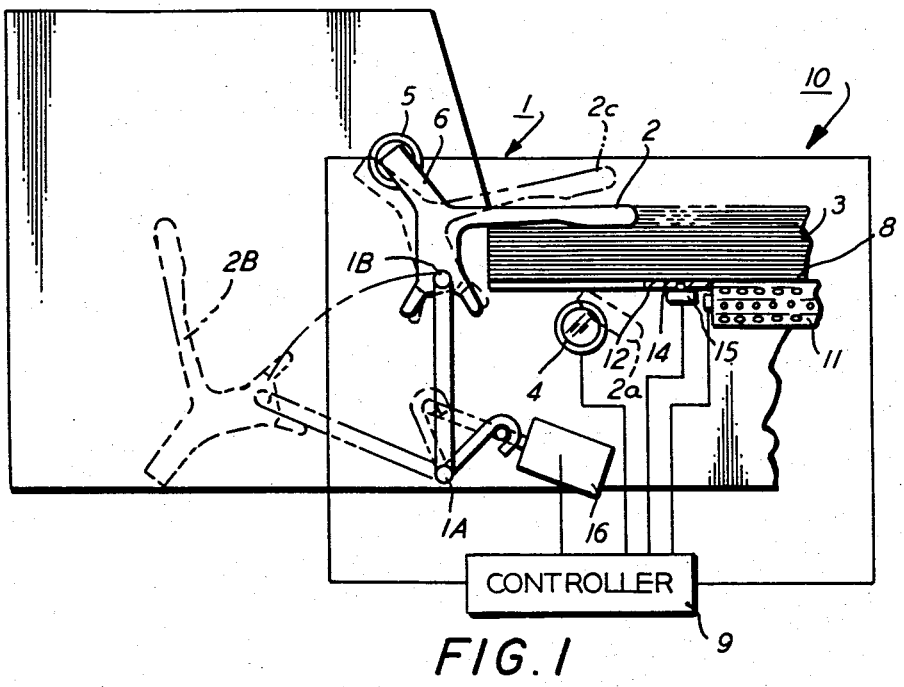
FIG. 1 is a partial front view of one embodiment of a document sheet handling apparatus with one embodiment of a sheet stack sensing system in accordance with the present invention.

The exemplary document sheet handling system 10 variously or partially disclosed in FIGS. 1–5 may be conventional except as described herein, and may be mounted to or a part of any conventional copier. Furthermore, the present system is applicable to numerous other sheet feeding systems, of which this is merely one example. Further details are described in the above cited and other references and need not be repeated herein.

The exemplary sheet handling system 10 here is a recirculating document sheet handler for precollation copying, in which a stack 3 of individual flimsy document sheets 8 are loaded into the generally horizontal and planar bottom surface 14 of a restacking tray 12 to be fed seriatim from the bottom of the stack 3 by a vacuum belt or other individual sheet output feeder 11, assisted by an air knife 13, both of which are adjacent the front or downstream edge of the stack. Each sheet 8, after it has been fed out to the copier platen and copied, is returned via a restacking feeder or transport which feeds the returning sheet in over the top of the stack 3 from the rear of the stack and releases the sheet to restack by settling down on top of the stack between aligning edge guides. Thus, the sheets can be continuously recirculated in the same order as often as desired.

Referring now to the sensing and control system embodiment of FIG. 1, integral the automatic recirculating document handler 10, it includes a set separating finger or bail bar unit 1 used to separate or distinguish those documents to be fed from those which have been returned to the document tray 12 following the copy operation. An integral finger or bail 2 normally rests on the stack 3 lightly and moves down with gravity as sheets 8 are fed out from the bottom of the stack, and therefor from under the finger 2. When the finger 2 is no longer over any documents it drops through a slot in the tray bottom 14 into position 2*a* to activate a photoswitch 4 which signifies that all the document sheets in the set have been copied once. The finger 2 is then automatically reset to the initial position on top of the stack, as shown in solid line, to initiate another cycle, by a solenoid or other mechanism which pivots the entire bail unit 1 about axis 1*a* back to the (dashed line) position 2*b* and then up to the reset position. By employing a stack height photosensor 5 actuated by an internal extension or flag 6 of the finger 2 of the bail system 1, the reset position of the finger 2 on the top of the stack is utilized to give an indication of the stack height for automatically adjusting vacuum, air, or normal force pressures in the document feeder to compensate for the height (and therefore indirectly for the weight) of the stack. Here this is accomplished by allowing a limited degree of pivotability with variations in stack height of the integral arm unit 2, 6 about a second axis 1*b* so as to variably position flag 6 relative to sensor 5 depending on the stack height as illustrated by the dashed line alternative position 2*c*. More than one sensor 5 can be provided in the various potential reset positions of the arm 6, corresponding to different stack heights. This FIG. 1 system has been similarly disclosed by the same inventor in the Xerox Disclosure Journal, Vol. 6, No. 4, July/Aug. 1981 issue, p. 167, published on or about Aug. 11, 1981. Here there is also shown a connected controller 9, document sheet feeder 11, fed sheet counter 15 and solenoid 16.

Figure 3:
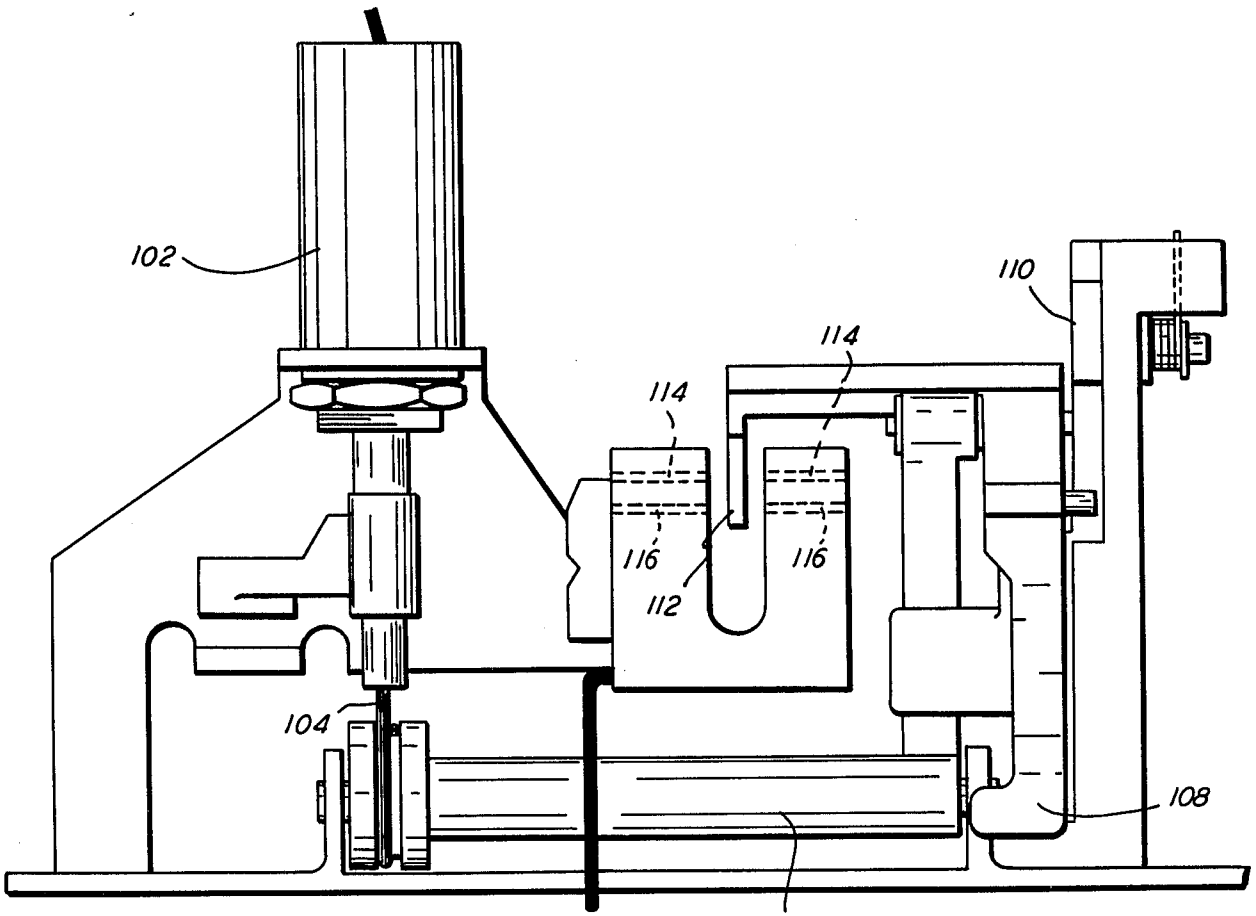
FIG. 3 is a side view of the embodiment of FIG. 2.
Figure 4:
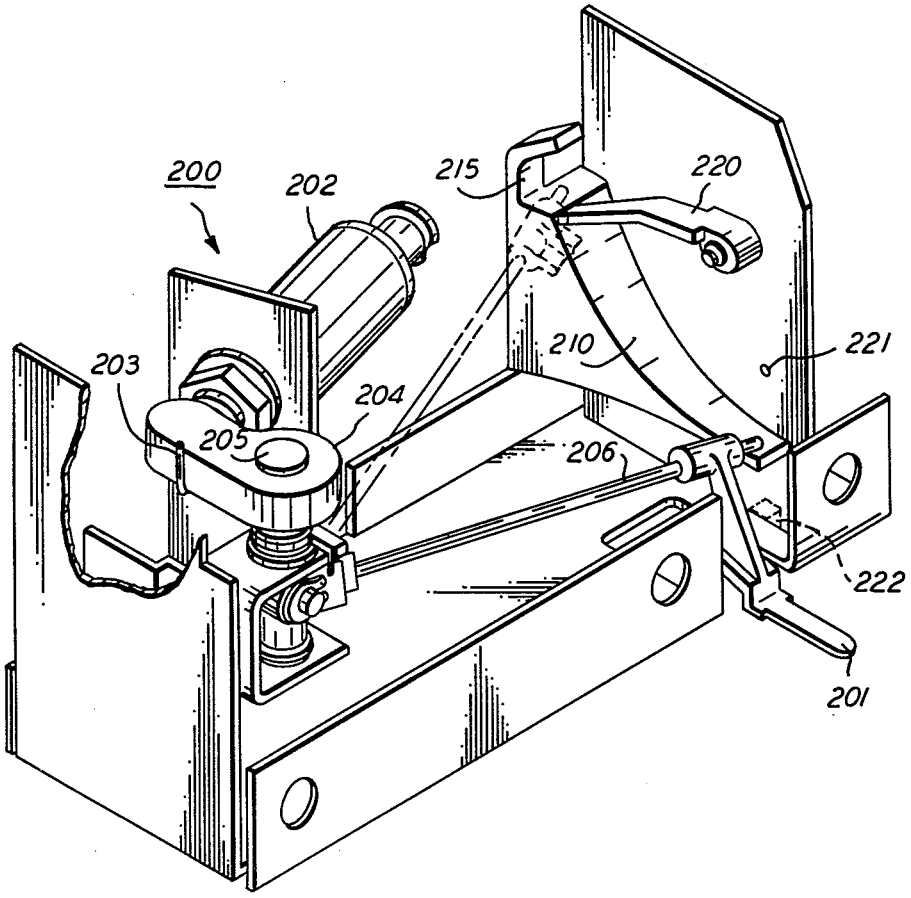
FIG. 4 is a perspective view of a third embodiment thereof.

Turning now to FIG. 4, there is illustrated an alternative exemplary set separator unit 200 per se. It is essentially FIG. 3 of U.K. patent application GB Pat. No. 2,058,023A published Apr. 8, 1981 cited above. This unit has been modified here in accordance with the present invention (for use as a component of one embodiment thereof), by the addition of a first or upper sensor switch 221 and a second or lower sensor switch 222, corresponding respectively to the switches 5 and 4 of the FIG. 1 embodiment. As basically indicated in said U.K. Publication, after a complete set or book 1 is placed in the tray, solenoid 202 is energized, which in turn pushes its plunger against the counterforce of spring 203 and moves lever 204 which is connected through shaft 205 to one end of shaft 206. Shaft 206 supports separator member 201. The activation of solenoid 202 through the movement of shaft 206 retracts finger member 201 out from under the stack and up along cam surface 210 and under the end of pivotably mounted cam 220 (which it lifts) into a stop area 215, as shown by the dashed line position. It is only at the stop area 215 momentarily, then de-energization of solenoid 202 allows spring means 203 to propel shaft 206 forwardly over the upper surface of cam 220 until it drops off the end of cam 220 over the stack (not shown). Thus separator 201 comes to rest on what is now the top of the set or stack. Shaft 206 is pivotably mounted to allow separator member 201 to move freely vertically by gravity except when its movement is so controlled by cam surfaces 210 and 220 during resetting. Thus the level of the sheets under the member 201 normally controls its position.

As disclosed herein, if the stack is sufficiently high, the rear portion of separator member 201 in its initial reset position on top of the stack will function as a flag activating photo-optical switch 221, which is positioned at a preset level above the bottom of the stack support tray, if the stack height is above this preset level. In either case, however, once all the sheets in the stack have been fed out from under the extended finger 201 it will drop below the tray bottom to activate the second switch 222.

Figure 2:
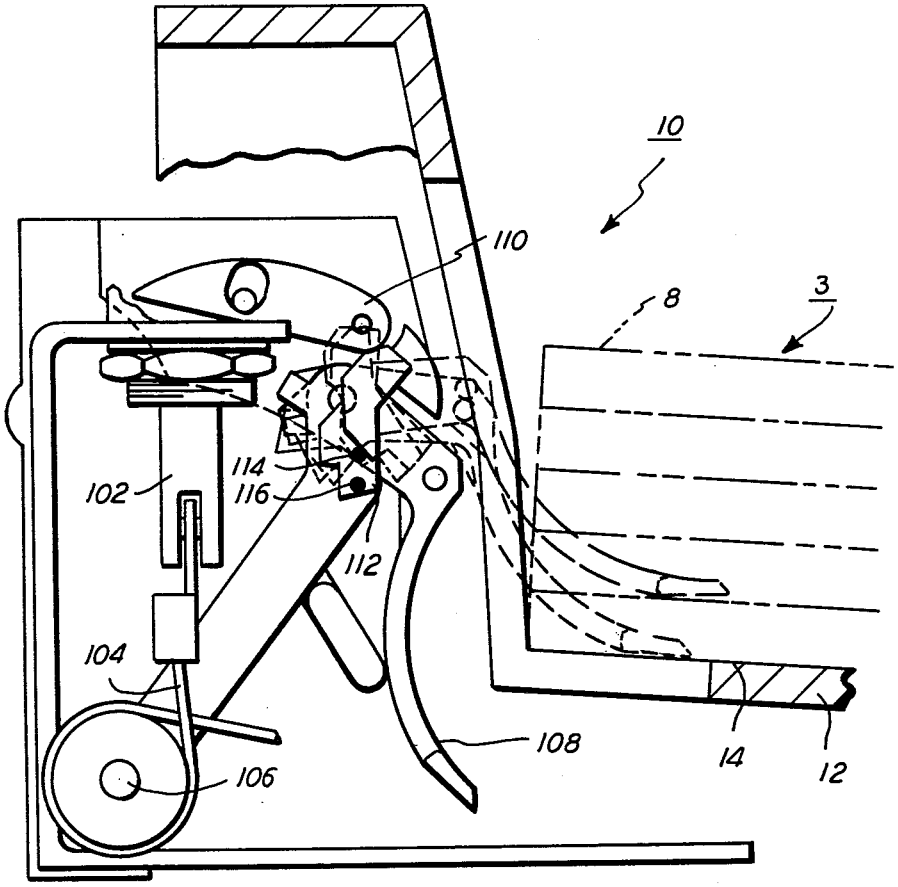
FIG. 2 is a partial front view of a second embodiment of another stack sensing system in accordance with the present invention.

Turning now to FIGS. 2 and 3, there is disclosed another alternative sensor unit. Here the actuation of solenoid 102 pulls cable 104 which rotates shaft 106 to reset the finger member 108 on top of the stack of sheets, via a cam 110 similar to the cam 220 of FIG. 4. Here an integral extension member 112 of finger unit 108 serves as an activating flag for commercial paired integral photo-optical sensor pairs 114 and 116. The upper sensor pair 114 is actuated only by a shaped flag 112 being rotated downward sufficiently to interrupt its infra-red light beam. As shown, this occurs when the finger member 108 has dropped into its illustrated solid line position, or in its lower dashed-line position but not in its upper (higher) dashed line position. In contrast, the lower sensor pair 116 beam is broken by the flag 112 only when the finger 108 has dropped below the tray bottom surface, i.e. is in its solid line position.

Figure 5:
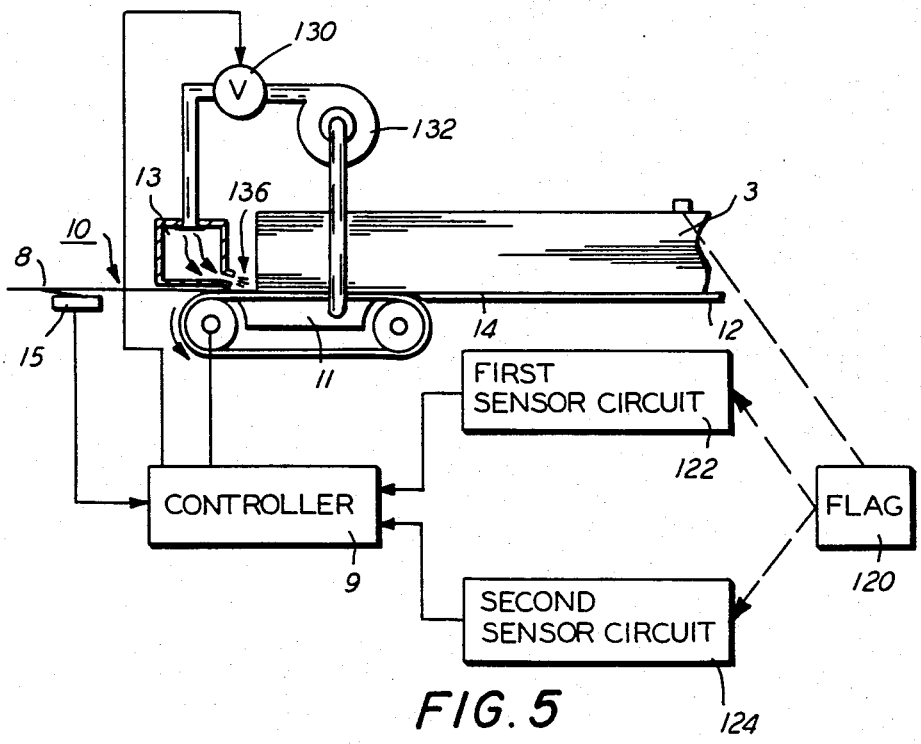
FIG. 5 is a functional schematic drawing of an exemplary electrical control system or logic diagram for any of the embodiments of FIGS. 1–4 with a partial side view of the exemplary document sheet handling apparatus of FIG. 1.

Referring now to FIG. 5, there is shown a functional or schematic logic system which may be utilized with any of the set separators and switches shown above or other suitable sensors for providing the desired functions. The flag 120 activates one or both of the sensor circuits 122 and 124. The first sensor circuit 122 corresponds to the exemplary sensors 5 of FIG. 1, 114 of FIGS. 2–3, and 221 of FIG. 4. Correspondingly, the FIG. 5 second sensor circuit 124 is or corresponds to the other (end of set) sensors 4, 116 or 222 of those figures.

The FIG. 5 controller or comparator 9 has inputs from the two sensor circuits 122 and 124 and also the sheet counter 15 counting sheets 8 fed by the sheet feed vacuum belt feed unit 11 (as in FIG. 1). The output of the controller 9 utilizes those inputs as described herein to control high/low or two-level air valve 130 connecting between and controlling air pressure and/or velocity from blower 132 to air knife manifold 13 which directs a variable pneumatic sheet separating assistance air flow pattern 136 against the sheets being fed as described in further detail in the reference cited thereon above. The pressure and/or velocity of this air flow or air knife 136 is determined by the setting of valve 130 by controller 9 by a simple comparison of the controller input signals. Specifically, the activation or non-activation of first sensor 122 determines the initial setting (high or low) of the air knife 13 output. A higher pneumatic separating force is provided for a higher, and thus heavier, stack of sheets to assist separation and feeding by bottom feeder 11, or a lower pneumatic force is provided for a lower stack of sheets to prevent overblowing which could interfere with paper feeding by feeder 11.

However, since the above stack height sensing aspect of this system is not as accurate in determining stack weight as an actual count of the sheets, an additional feature is provided. Upon the counting from switch 15 of the feeding of more than a preset number of sheets in one set, i.e. a preset count reached before the second or set counter switch 124 is reactivated, this input is connected to controller 9 to override the initial determination made from the first switch 122 input, if different, and to reset valve 130 accordingly, I.e. to raise or lower the air knife output from its initial setting up to that point in time, and to maintain this second or revised setting for all subsequent sheet feeding, including all subsequent set circulations, for the most accurate air knife level for the particular document set being circulated, thereby minimizing misfeeds or jams.

It will be appreciated that the embodiments described herein are merely, exemplary, and that numerous other variations, modifications, refinements or alternatives will be apparent to those skilled in the art from the disclosures herein. They are intended to be encompassed by the following claims:

What is claimed is:

1. In a sheet feeder with a sheet stack support wherein sheets are fed from a stack of the sheets in said stack support using variable pneumatic feeding means, the improvement comprising an automatic integral plural mode sheet stack sensor which, in a first mode, controls said variable pneumatic feeding means in response to sensing the height of the stack of sheets in said stack support, and which, in a second mode, provides a signal indicative of the feeding from said stack support of all of the sheets in said stack, wherein said integral plural mode sheet stack sensor includes:

a finger member, means for resetting said finger member on top of the stack of sheets, first switch means actuable by a first position of said finger member said first mode when said finger member is reset on top of the stack of sheets and the height of said stack of sheets in said stack support exceeds a preset level, and second switch means actuable for said second mode by the dropping of said finger member into a second position in response to all of the sheets being fed out from under said finger member.

2. The apparatus of claim 1 wherein said variable pneumatic feeding means including a pneumatic sheet separator for separating the sheets in said stack with air pressure and wherein said sheet stack sensor in said first mode initially increases said air pressure to said pneumatic sheet separator operating on said stack in response to sensing that the height of the stack exceeds a preset level.

3. The apparatus of claim 1 wherein sheet counting means operatively connecting with said second mode signal are provided to count the sheets fed from said stack, and wherein said sheet counting means are also connected to control said variable pneumatic feeding means, and are connected to over-ride said first mode control from said sheet stack sensor in response to counting a number of sheets differing from a preset sheet count.

4. The apparatus of claim 1 wherein said sheet stack sensor finger member has an integral flag extension member adapted to selectively interrupt selected ones of a plurality of light beam sensors in response to the finger member position, which finger member position is normally controlled by a portion of said finger member resting on said stack and being freely movable downwardly by gravity as sheets are fed out from under it.

5. The apparatus of claim 3 wherein said variable pneumatic feeding means including a pneumatic sheet separator for separating the sheets in said stack with air pressure and wherein said sheet stack sensor in said first mode initially increases said air pressure to said pneumatic sheet separator operating on said stack in response to sensing that the height of the stack exceeds a preset level, but wherein said air pressure is lowered in response to counting a number of sheets fed from said stack which is less than a preset number before said second mode signal indicative of feeding of all of the sheets in the stack.

6. In a method of feeding sheets from the bottom of a sheet stack using variable pneumatic sheet feeding means, the improvement comprising sensing, with an automatic integral plural mode sheet stack sensor, the height of the stack of sheets in said stack support in a first mode to control the variable pneumatic sheet feeding means, and sensing in a second mode, with said same integral sheet stack sensor, the feeding from said stack support of all of the sheets in said stack and providing a signal indicative thereof, further including the steps of setting a finger member on top of the stack of sheets in said first mode and activating first switch means in response to a first position of said finger member when said finger member is set on top of the stack of sheets and the height of the stack of sheets in a stack support exceeds a preset level, then allowing said finger member to drop by gravity as sheets are fed out from under it, and actuating second switch means for said second mode by the dropping of said finger member into a second position in response to all of the sheets being fed out from under said finger.

7. The method of claim 6 wherein the sheets fed from said stack are counted, and said count is compared to a preset number, and said count comparison is connected to over-side said first mode control from said sheet stack sensor in response to counting a number of sheets differing from said preset number prior to the next second mode signal from said integral sheet stack sensor.

* * * * *